US011600949B2

(12) United States Patent
Razvan

(10) Patent No.: US 11,600,949 B2
(45) Date of Patent: Mar. 7, 2023

(54) ASSEMBLY COMPRISING A FIRST CONNECTOR, A SECOND CONNECTOR AND A CODING SYSTEM SELECTIVELY ALLOWING CONNECTION

(71) Applicant: ULTRATECH, Le Chesnay (FR)

(72) Inventor: Ilie Razvan, Rocquencourt (FR)

(73) Assignee: Ultratech, Le Chesnay (FR)

( * ) Notice: Subject to any disclaimer, the term of this patent is extended or adjusted under 35 U.S.C. 154(b) by 0 days.

(21) Appl. No.: 17/451,152

(22) Filed: Nov. 22, 2021

(65) Prior Publication Data

US 2022/0224050 A1 Jul. 14, 2022

(30) Foreign Application Priority Data

Oct. 16, 2020 (FR) ..... 20 10625

(51) Int. Cl.
*H01R 13/645* (2006.01)
*H01R 27/00* (2006.01)

(52) U.S. Cl.
CPC ..... *H01R 13/6456* (2013.01); *H01R 27/00* (2013.01)

(58) Field of Classification Search
CPC .. H01R 13/6456; H01R 27/00; H01R 24/005; H01R 13/6453
See application file for complete search history.

(56) References Cited

U.S. PATENT DOCUMENTS 4,193,655 A 3/1980 Herrmann, Jr.
4,478,473 A * 10/1984 Frear ..... H01R 13/622 439/312
4,534,607 A * 8/1985 Tomsa ..... H01R 13/641 439/312
4,940,416 A * 7/1990 Wagaman ..... H01R 13/523 439/204
5,590,228 A * 12/1996 Gibola ..... H01R 13/622 385/75
6,309,231 B1 * 10/2001 Gordon ..... H01R 13/625 439/889

OTHER PUBLICATIONS

Preliminary Search Report for FR 20 10265, dated Jun. 11, 2021.

* cited by examiner

*Primary Examiner* — Travis S Chambers
(74) *Attorney, Agent, or Firm* — Marshall, Gerstein & Borun LLP

(57) ABSTRACT

An assembly (10) includes a first connector (12), and a second connector (14) mobile in axial translation relative to the first connector, a first part (16) attached to the first connector, and a first sleeve (18) axially rotatable relative to the first part between a first plurality of positions, a first blocking device (20) blocking the first sleeve, a second part (22) attached to the second connector, and a second sleeve (24) axially rotatable relative to the second part between a second plurality of positions, a second blocking device (26) blocking the second sleeve. The first sleeve, the first part, the second sleeve, and the second part have shapes that provide a coding that allows connection only if the position of the first sleeve matches the position of the second sleeve.

10 Claims, 5 Drawing Sheets

ASSEMBLY COMPRISING A FIRST CONNECTOR, A SECOND CONNECTOR AND A CODING SYSTEM SELECTIVELY ALLOWING CONNECTION

CROSS REFERENCE TO RELATED APPLICATION

The benefit of priority to French Patent Application No. 20 10625 filed Oct. 16, 2020, is hereby claimed and the disclosure is incorporated herein by reference.

BACKGROUND

Field of the Disclosure

This invention relates to an assembly comprising a first connector, and a second connector that can be moved in translation relative to the first connector along a connection axis between a disconnected position and a connected position.

Brief Description of Related Technology

The connectors are for example electrical connectors. In order to avoid an unwanted connection between a first connector and a second connector, it is known that a coding system, also known as a "foolproofing" system, is used, allowing the connection between a first connector and a second compatible connector, and mechanically prohibiting any connection between a first connector and a second connector whose connection is unwanted, for electrical reasons, for example.

A known way of producing a coding system is to carry out specific machining of the first connector and the second connector, so as to allow or prohibit their connection. The coding system is then permanent, not changeable, and is rather called a foolproofing system. In order to change the coding system, i.e. for example to make a first connector compatible with a second connector which were not compatible, or to make a first connector and a second connector which were compatible incompatible, it is known that an end piece or an insert with machined surfaces is used for each of the connectors in order to achieve the coding. For example, to change the coding, one or both connector end pieces are replaced with new end pieces.

The disadvantage of the latter method is that changing the coding is relatively complex, and requires the use of a plurality of interchangeable end pieces or parts that can be easily misplaced.

An aim of the invention is therefore to provide an assembly comprising a first connector and a second connector, with a more user-friendly coding system.

BRIEF SUMMARY

To this end, the aim of the invention is to provide an assembly comprising a first connector, and a second connector that can be moved in translation relative to the first connector along a connection axis between a disconnected position, in which the second connector is spaced apart from the first connector, and a connected position, in which the first connector and the second connector are connected to each other, a first part attached to the first connector, and a first sleeve surrounding the first part about the connection axis, one of the first sleeve and the first part defining at least one first notch, and the other of the first sleeve and the first part defining a first plurality of notches, the first sleeve being rotatable about the connection axis relative to the first part between a first plurality of positions in which the first notch cooperates with a respective one of the first plurality of notches to form a first housing, the assembly comprising at least a first blocking device suitable for being received in the first housing and for blocking the first sleeve against rotating in one of the first plurality of positions, and a second part attached to the second connector, and a second sleeve surrounding the second part about the connection axis, one of the second sleeve and the second part defining at least one second notch, and the other of the second sleeve and the second part defining a second plurality of notches, the second sleeve being rotatable about the connection axis relative to the second part between a second plurality of positions in which the second notch cooperates with a respective one of the second plurality of notches to form a second housing, the assembly comprising at least a second blocking device suitable for being received in the second housing and for blocking the second sleeve against rotating in one of the second plurality of positions, the first sleeve and the first part, on the one hand, and the second sleeve and the second part, on the other hand, having shapes suitable for, when the first sleeve is in any of the first plurality of positions:

allowing the second connector to move from the disconnected position to the connected position when the second sleeve is in a position corresponding to the second plurality of positions, the first sleeve sliding into or over the second sleeve, and the first part sliding into or over the second part during said movement; and blocking said movement if the second sleeve is in any other of the second plurality of positions, the first sleeve abutting the second sleeve, or the first part abutting the second part.

According to particular embodiments, the assembly has one or more of the following features taken in isolation or in any combination that is technically possible.

the first connector and the second connector are both electrical, pneumatic or hydraulic connectors;

the first sleeve defines at least one axially oriented guide rail; and the second sleeve defines at least one axial guide recess suitable for receiving the guide rail axially and to block the second sleeve from rotating relative to the first sleeve about the connection axis when the second connector moves from the disconnected position to the connected position;

the first sleeve has a first visual sign and the second sleeve has a second visual sign, the first visual sign and the second visual sign being axially aligned when the guide rail is received in the guide recess;

one of the first part and the second part defines at least one axially oriented coding recess and the other of the first part and the second part defines at least one radial coding protrusion suitable for being axially received in the coding recess when the second sleeve is in said one of the second plurality of positions to allow the second connector to move from the disconnected position to the connected position, and suitable for abutting axially against said one of the first part and the second part when the second sleeve is in any other of the second plurality of positions to block said movement;

the first blocking device and the second blocking device are pins;

each of the first blocking device and the second blocking device comprises a main part suitable for being inserted into the first housing and the second housing respectively, and a gripping part intended to be grasped by an operator;

the assembly further comprises a first locking device suitable for attachment to the first sleeve or part and for blocking the first blocking device in the first housing by abutting axially against an abutment surface defined by the first blocking device, and comprises a second locking device suitable for attachment to the second sleeve or part and for blocking the second blocking device in the second housing by abutting axially against an abutment surface defined by the second blocking device;

the first locking device and the second locking device respectively comprise a snap ring, the first sleeve and the second sleeve defining a retention groove suitable for receiving the snap ring, the retention groove extending around the connection axis on a radially inner surface of the first sleeve and the second sleeve respectively;

the gripping part and the abutment surface of the main part are formed by a shoulder of the first blocking device and the second blocking device respectively; and the first sleeve includes a third visual sign, and the second sleeve includes a fourth visual sign, the third visual sign being representative of a given position occupied by the first sleeve among the first plurality of positions, and the fourth visual sign being representative of a given position occupied by the second sleeve among the second plurality of positions.

BRIEF DESCRIPTION OF THE DRAWINGS

The invention will be better understood upon reading the following description, given only as an example, and with reference to the attached drawings, in which.

DETAILED DESCRIPTION

Figure 1:
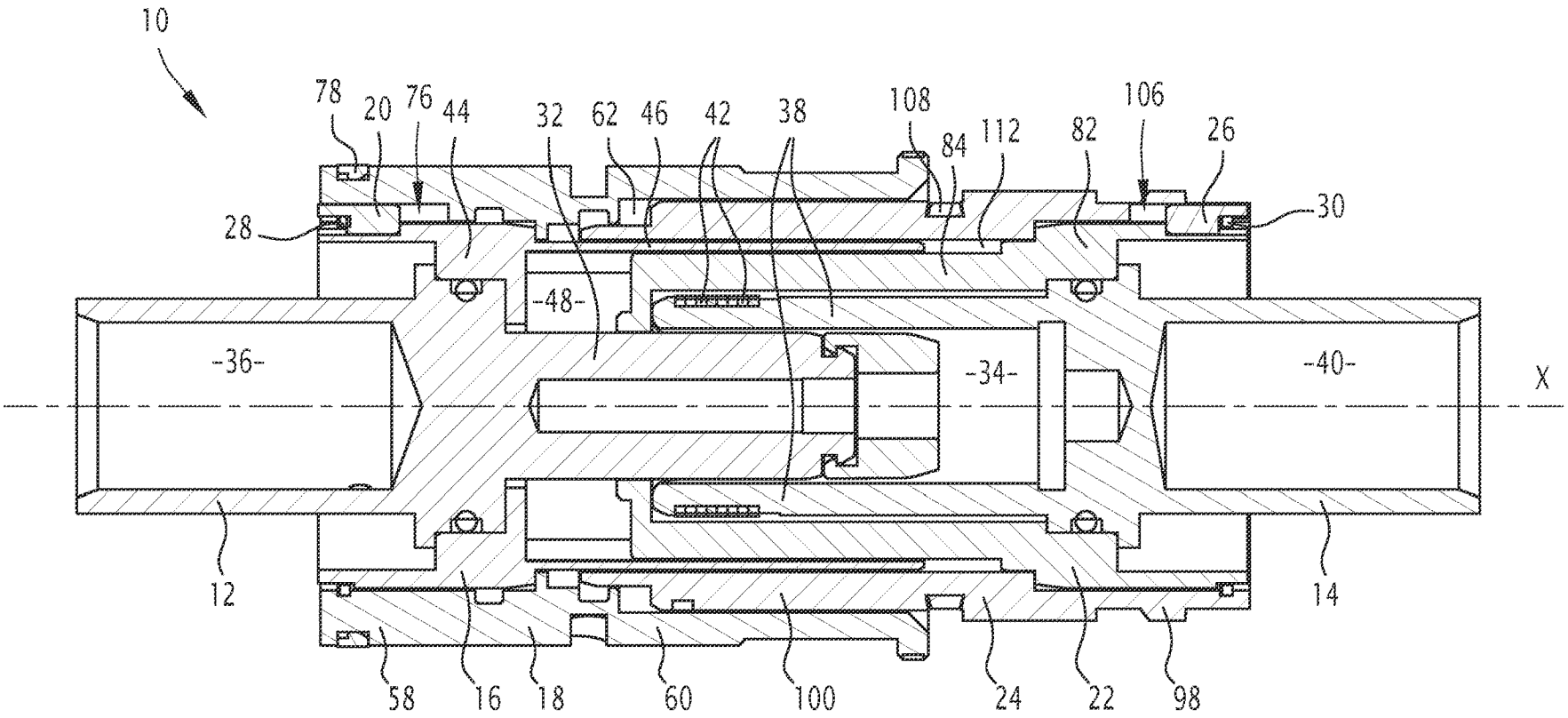
FIG. 1 is a schematic cross-sectional view through the connection axis of an assembly according to the invention.

With reference to FIG. 1, an assembly 10 according to the invention is described.

Assembly 10 comprises a first connector 12, and a second connector 14 which can be moved in translation relative to the first connector along a connection axis X between a connected position (shown in FIG. 1), in which the first connector and the second connector are mechanically connected to each other, and a disconnected position (not shown, but which can be deduced from FIG. 1 by moving the first connector and the second connector apart from each other axially).

Assembly 10 comprises a first part 16 fixed to the first connector 12, and a first sleeve 18 surrounding the first part about the connection axis X and mounted so as to be rotatable about the connection axis relative to the first part between a first plurality of positions (one of which is shown in FIG. 1, the others being deduced by successive rotations of the sleeve 18 about the connection axis X). Assembly 10 also includes a first blocking device 20 suitable for blocking the first sleeve 18 against rotating in one of the first plurality of positions.

Symmetrically, assembly 10 comprises a second part 22 fixed to the second connector 14, and a second sleeve 24 surrounding the second part 22 about the connection axis X and mounted so as to be rotatable about the connection axis relative to the second part between a second plurality of positions (one of which is shown in FIG. 1, the others being deduced by rotations of the second sleeve 24 about the connection axis X). Assembly 10 also includes a second blocking device 26 suitable for blocking the second sleeve 24 against rotating in one of the second plurality of positions.

Advantageously, assembly 10 also comprises a first locking device 28 (FIG. 3) and a second locking device 30 (FIG. 4), respectively suitable for blocking the first blocking device 20 and the second blocking device 26 in axial translation respectively with respect to the first part 16 and the second part 22.

The first part 16, the first sleeve 18 and the first blocking device 20, on the one hand, and the second part 12, the second sleeve 24 and the second blocking device 26, on the other hand, are adapted to form a coding system together.

In the example shown, the first connector 12 and the second connector 14 are electrical connectors. They are therefore electrically connected to each other in the connected position, and electrically disconnected in the disconnected position.

In an embodiment not shown, the first connector 12 and the second connector 14 are pneumatic or hydraulic connectors, i.e. connectors that allow a gaseous, e.g. air, or liquid, e.g. oil, medium to pass through them in the connected position.

In the example shown, the first connector 12 is a male connector having a distal portion 32 (FIG. 1) to be received in a housing 34 defined by the second connector 14, which is therefore a female connector in the example. The first connector 12 defines, for example, a proximal housing 36 for receiving an electrical cable not shown.

The terms "distal" and "proximal" refer to elements located respectively on the side remote from the electrical cable, or on the contrary close to the electrical cable along the connection axis X. In the first connector 12, the distal side is that of the part 32, while the proximal side is that of the housing 36.

The second connector 14 advantageously comprises a plurality of axially oriented strips 38 which radially delimit the housing 34. The second connector 14 defines, for example, a housing 40 for receiving an electrical cable not shown. Advantageously, the second electrical connector 14 comprises one or more bracing elements 42, for example metal "C" rings, suitable for pressing the strips 38 against the part 32 of the first connector 12.

The first connector 12 and the second connector 14 are advantageously substantially axisymmetric.

The first part 16 and the first sleeve 18, on the one hand, and the second part 22 and the second sleeve 24, on the other hand, are shaped so that when the first sleeve is in any one of the first plurality of positions, the second connector 14 is able to move from the disconnected position to the connected position if the second sleeve 24 is in a (predefined) one of the second plurality of positions, with the first sleeve sliding over the second sleeve in the example shown, and the first part sliding over the second part during this movement. On the other hand, if the second sleeve 24 is in any other of the second plurality of positions (i.e. not the predefined one), the said transition from the disconnected to the connected position is blocked, the first part 16 abutting in the example shown on the second part 22 axially.

Thus, in the example shown, the first sleeve 18 at least partially covers the second sleeve 24 in the connected position.

In an embodiment not shown, the second sleeve 24 at least partially covers the first sleeve 18 in the connected position. In this embodiment, the first sleeve 18 is adapted to slide into the second sleeve 24 when moving from the disconnected position to the connected position.

In the example shown, the first part 16 at least partially covers the second part 22 in the connected position.

In an embodiment not shown, the second part 22 at least partially covers the first part 16 in the connected position. The first part 16 is then suitable for sliding into the second part 22 when moving from the disconnected position to the connected position.

In an embodiment not shown, the first part 16 and/or the second part 22 are made up of several elements that are integral with each other.

The first part 16 comprises a proximal portion 44 attached to the first connector 12, and a distal portion 46 defining a generally cylindrical housing 48 for receiving the second part 22 in the connected position.

The distal portion 46 defines an axially oriented coding recess 50 (FIG. 2), and advantageously further recesses 52, for example three in number.

The term "recess" is used in this document to mean a shape that can be obtained by hollowing out, but also by other means, such as moulding.

The coding recess 50 and the other recesses 52 open out axially on the distal side.

The coding recess 50 is for example wider in the circumferential direction than the recesses 52. The recesses 52 are for example structurally similar to each other.

For example, the coding recess 50 and the recesses 52 are located at approximately 90° to each other about the connection axis X.

The coding recess 50 and the recesses 52 are, in the example shown, located on a radially inner face 53 of the distal part 46, since the first part 16 is intended to cover the second part 22 in the connected position.

The coding recess 50 and the recesses 52 form grooves, for example.

In one embodiment (not shown), these recesses may have a rounded profile and edges.

Figure 3:
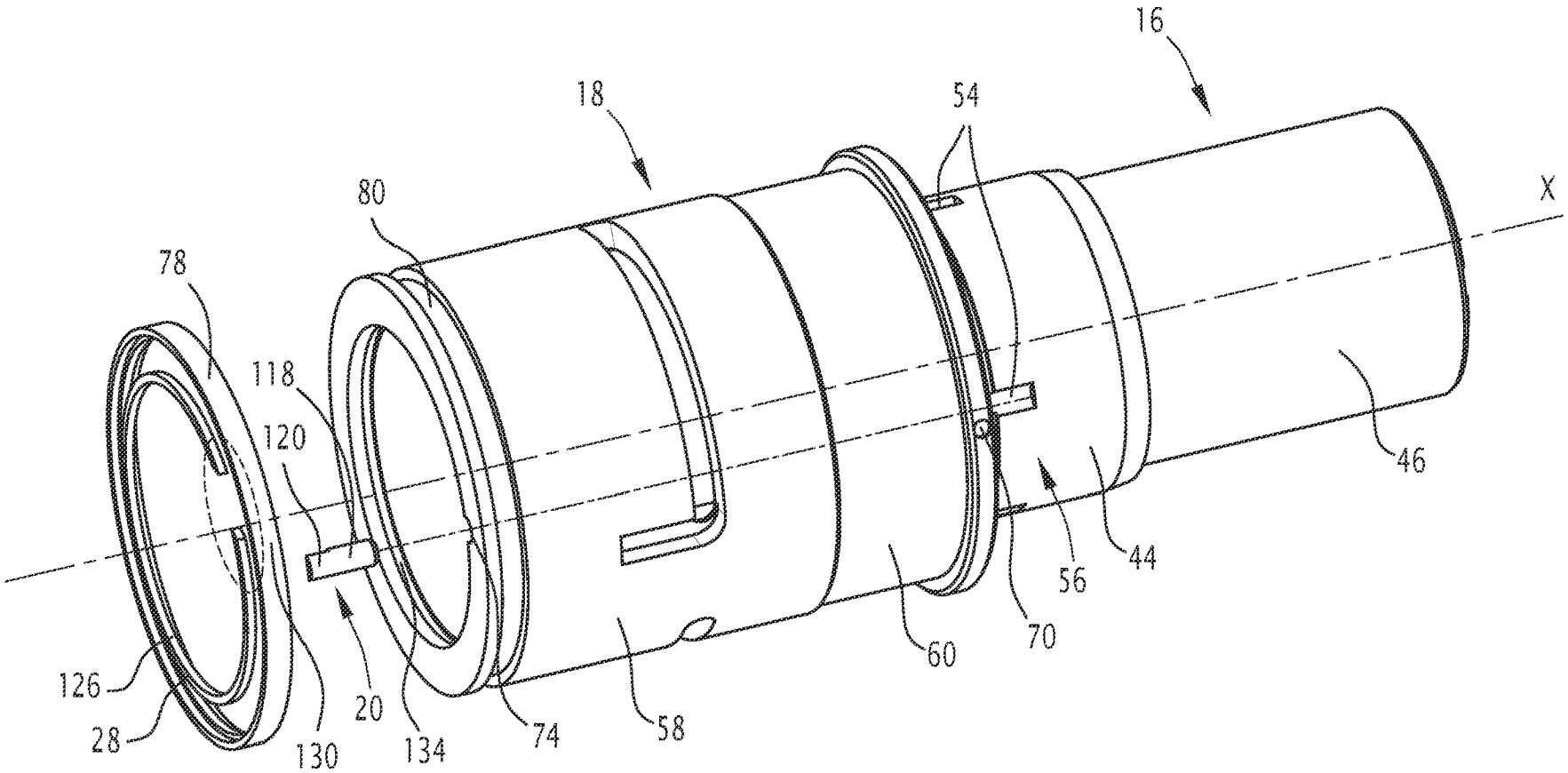
FIG. 3 is an exploded schematic perspective view, showing in particular the first part and the first sleeve shown in FIGS. 1 and 2, the first blocking device and the first locking device.
Figure 4:
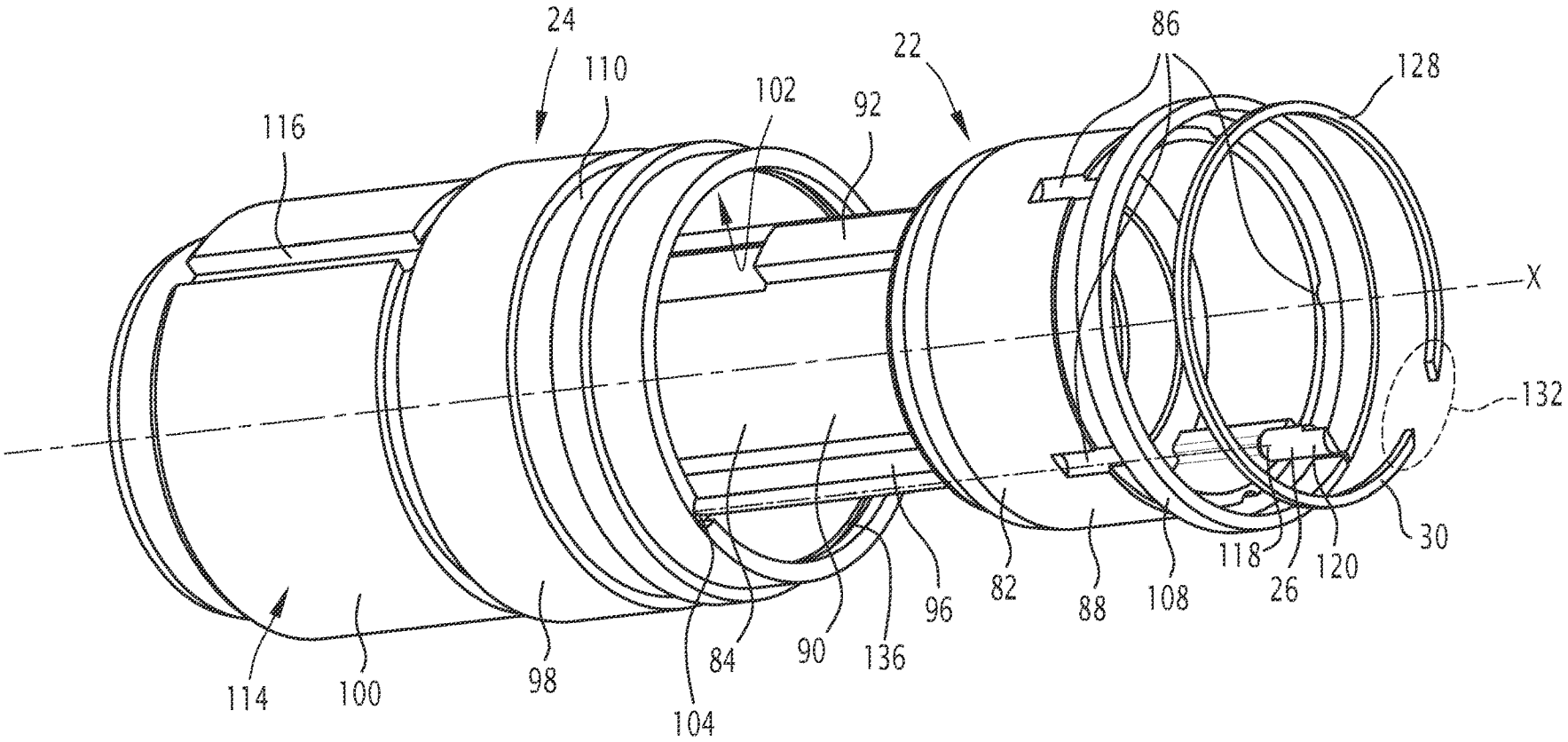
FIG. 4 is an exploded schematic perspective view showing the second part, the second sleeve, the second blocking device and the second locking device shown in FIG. 1.

As seen in FIG. 3, the proximal portion 44 defines a first plurality of notches 54 angularly distributed about the connection axis X on a radially outer surface 56 of the proximal portion 44. In the example shown, the notches 54 are five in number. This number is at least two, and may be three, four, six or more.

As seen in FIG. 1, the first sleeve 18 comprises a proximal portion 58 mounted to the proximal portion 44 of the first part 16, and a distal portion 60 defining with the distal portion 46 of the first part 16 a generally annular housing 62 for receiving the second sleeve 24 in the connected position.

Figure 2:
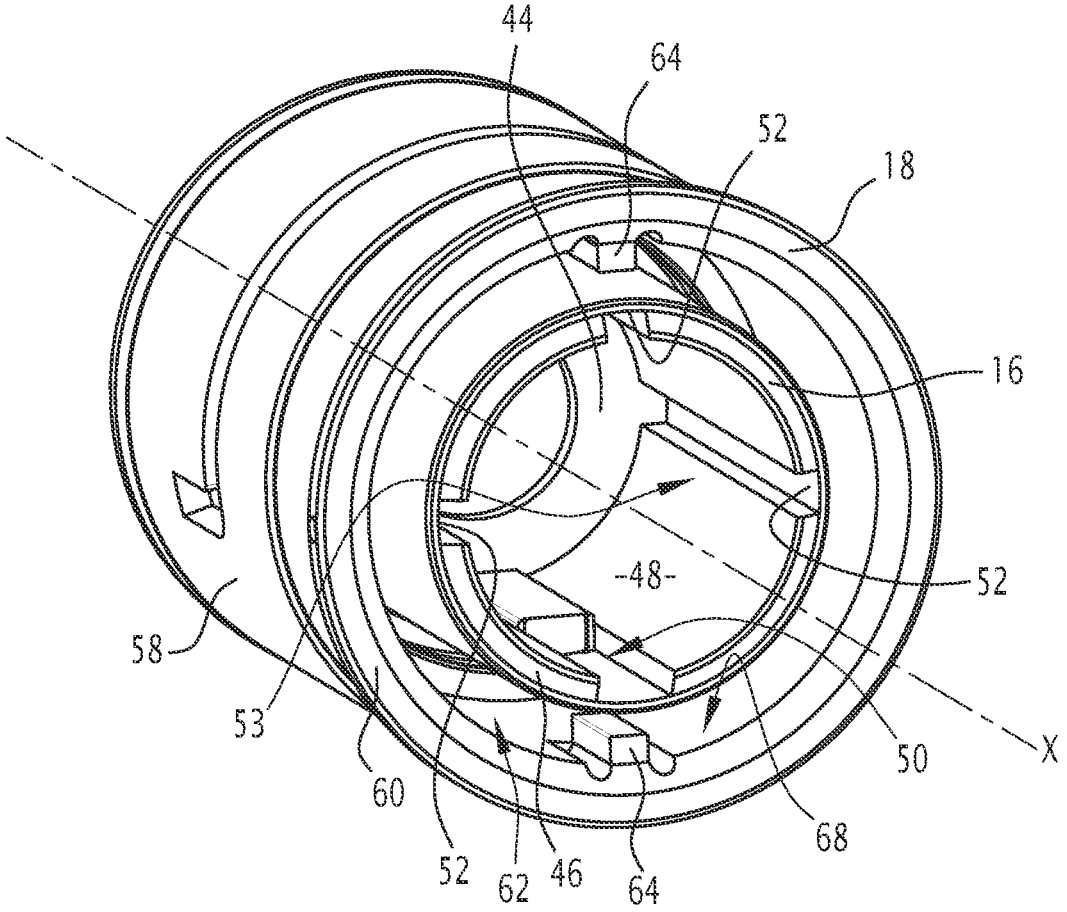
FIG. 2 is a schematic representation in perspective view of the first part and the first sleeve represented on FIG. 1.

The distal portion 60 defines for example two axially oriented guide rails 64 (FIG. 2).

In an embodiment not shown, a single guide rail 64 is sufficient.

In the example shown, the guide rails 64 are located on a radially inner surface 68 of the first sleeve 18.

Figure 5:
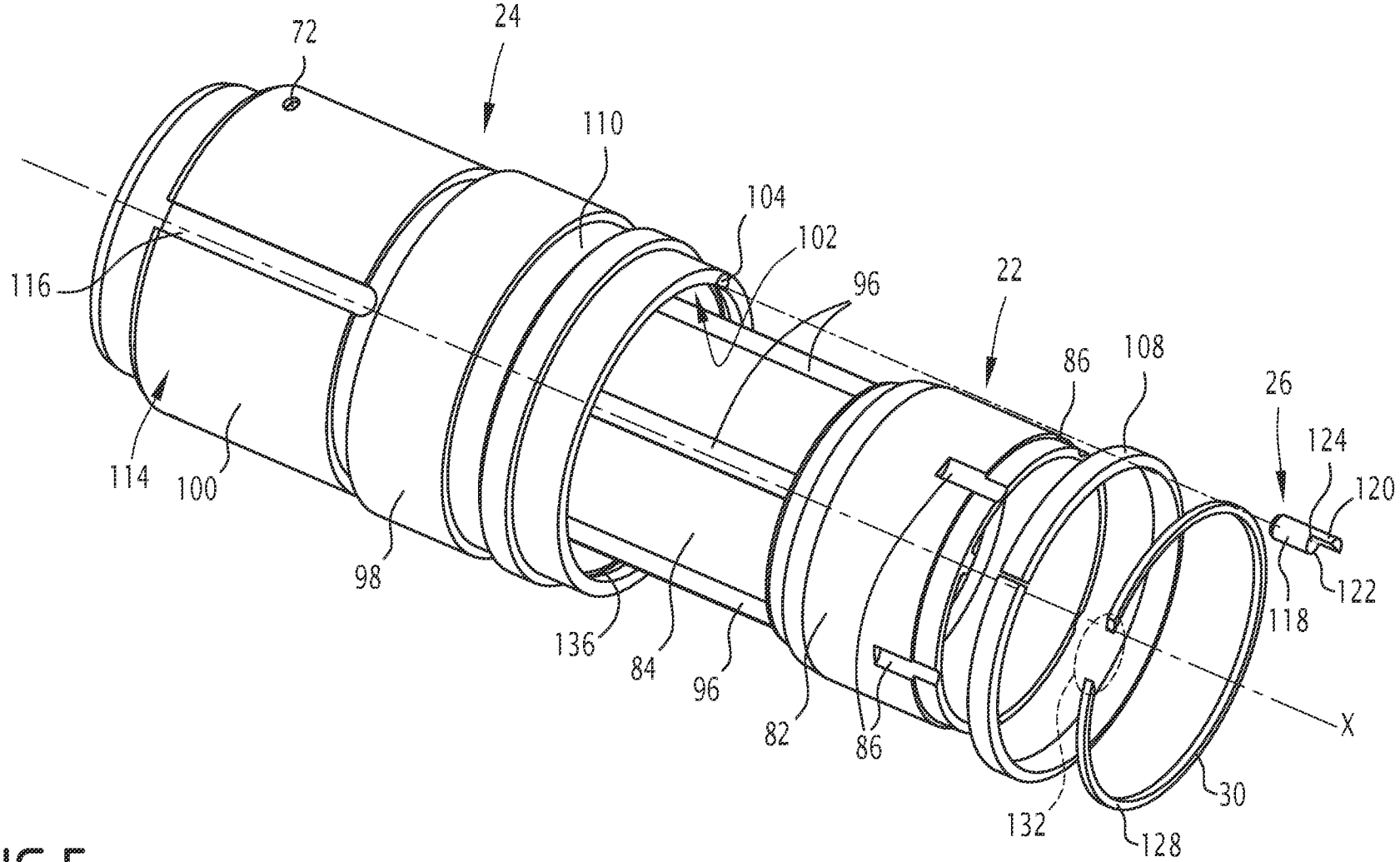
FIG. 5 is a similar view to FIG. 4, with the parts shown at a different angle to the connection axis.

The distal portion 60 comprises a first visual sign 70 (FIG. 3), for example a coloured mark, intended to be axially aligned with a similar second visual sign 72 of the second sleeve 24 (FIG. 5).

The proximal portion 58 defines a first notch 74 (FIG. 3) suitable for cooperating with one of the first plurality of notches 54 to form a housing 76 (FIG. 1). The proximal portion 58 includes a third visual sign 78 representative of a given position occupied by the first sleeve 18 among the first plurality of positions.

The housing 76 formed by the first notch 74 and one of the first plurality of notches 54 is adapted to axially receive the first blocking device 20 to block the first sleeve 18 against rotating in one of the first plurality of positions.

The third visual sign 78 is, for example, a coloured ring located in a circumferential groove 80 (FIG. 3) defined by the proximal part 58.

The second part 22 (FIGS. 1, 4 and 5) comprises a proximal portion 82 attached to the second connector 14, and a distal portion 84 surrounding the strips 38 around the connection axis X.

The proximal portion 82 defines a second plurality of notches 86 angularly distributed about the connection axis X and located on a radially outer surface 88 of the proximal portion 82.

The distal portion 84 is intended to be at least partially received in the housing 48 in the connected position, i.e. radially between the distal portion 32 of the first connector 12 and the distal portion 46 of the first part 16.

The distal portion 84 of the second part 22 has a radially outer surface 90 forming a coding protrusion 92 (FIG. 4) adapted to slide axially into the coding recess 50 of the first part 16 when moving from the disconnected position to the connected position. In the example shown, the distal portion 84 also defines three further protrusions 96 (FIGS. 4 and 5) suitable for cooperating with the recesses 52 of the first part 16 during this movement.

The second sleeve 24 comprises a proximal portion 98 mounted for rotation on the second connector 14 between the second plurality of positions about the connection axis X, and a distal portion 100 intended to be at least partially received in the housing 62 in the connected position, that is to say radially between the distal portion 46 of the first part 16 and the distal portion 60 of the first sleeve 18.

A radially inner surface 102 of the second sleeve 22 defines a second notch 104 (FIGS. 4 and 5) suitable for cooperating with a respective one of the second plurality of notches 86 depending on the angular position occupied by the second sleeve 24 of the second plurality of positions, to form a second housing 106 (FIG. 1). The proximal part 98 advantageously comprises a fourth visual sign 108, for example a coloured ring received in a circumferential groove 110 defined by the proximal part 98.

The second housing 106 is suitable for axially receiving the second blocking device 26 to block the second sleeve 24 against rotating relative to the second part 22 in one of the second plurality of positions.

The fourth visual sign 108 is representative of the position that the second sleeve 24 occupies among this plurality of positions.

The distal portion 100 of the second sleeve 24 is for example generally cylindrical in shape defining with the distal portion 84 of the first part 22 a housing 112 (FIG. 1) for receiving at least a portion of the distal portion 46 of the first part 16 in the connected position.

The distal portion 100 has a radially outer surface 114 defining two axial guide recesses 116 (FIGS. 4 and 5) suitable for receiving the guide rails 64 of the first sleeve 18 when moving from the disconnected position to the connected position.

In one embodiment, the distal portion 100 defines only one guide recess 116.

In the example shown, the guide recesses 116 are diametrically opposed to the connection axis X.

In other embodiments not shown, the distal portion 100 defines more than two guide recesses 116.

For example, the recesses 116 form grooves.

In an embodiment (not shown), they may have a rounded profile and edges.

The second visual sign 72 (FIG. 5) is advantageously included in the distal part 100. When the second visual sign 72 is axially aligned with the first visual sign 70, the guide recesses 116 are aligned with the guide rails 64.

The first blocking device 20 and the second blocking device 26 are advantageously similar to each other structurally, and are for example pins. Each of the first blocking device 20 and the second blocking device 26 comprises a main part 118 (FIG. 5) which is advantageously cylindrical, and a gripping part 120 intended to be grasped by an operator (not shown).

The gripping part 120 is advantageously located in the axial extension of the main part 118. The gripping part 120 of the first blocking device 20 and the second blocking device 26 is located relative to the main portion 118 on the proximal side of the first connector 12 and the second connector 14 respectively.

The main part 118 defines an abutment surface 122 for the first locking device 28 and the second locking device 30 respectively.

The abutment surface 122 and the gripping part 120 are advantageously formed by a shoulder 124 of the first blocking device 20 and the second blocking device 26 respectively.

The first locking device 28 and the second locking device 30 are advantageously made up of two rings 126, 128 advantageously having interruptions 130, 132. In the example, they have a "C" shape.

Each of the first bocking device 28 and the second bocking device 30 is suitable for being received respectively in retention grooves 134, 136 extending around the connection axis X on the radially inner surfaces 68, 102 of the first sleeve 18 and the second sleeve 24.

The first locking device 28 and the second locking device 30 are suitable for abutting axially against the abutment surfaces 122 of the first blocking device 20 and the second blocking device 26 respectively, the gripping part 120 being located for example on the radially outer side of the snap rings 126, 128.

The operation of assembly 10 will now be described.

Assembly 10 is initially in the disconnected position.

To perform the coding on the side of the first connector 12, the first blocking device 28 is removed from the first housing 76. The first sleeve 18 is then free to rotate relative to the first part 16 about the connection axis X.

The operator then places the first sleeve 24 in one of the first plurality of positions, bringing the first notch 74 into angular correspondence with one of the first plurality of notches 54. This forms a new first housing 76 defined by the first notch 74 and the notch selected from the first plurality of notches 54. The operator introduces the first locking device 20 into the first housing 76 thus defined, which blocks the first sleeve 18 from rotating with respect to the first part 16, i.e. blocks the first sleeve 18 in one of the first plurality of positions.

Advantageously, the operator places the first locking device 28 in the retention groove 134. The first locking device 28 abuts axially against the first blocking device 20, preventing the latter from coming out of the first housing 76.

Potentially, the operator places the third visual sign 78 in the groove 80, selecting it in a colour representative of the position selected from the first plurality of positions.

Then the operator performs the coding on the side of the second connector 14 in the same way.

More precisely, the operator removes the blocking device 26 from the second housing 106 in which it was located, in order to release the second sleeve 24 to rotate with respect to the first part 22 about the connection axis X. The operator selects one of the second plurality of positions by bringing the second notch 104 into angular correspondence with one of the second plurality of notches 86. This defines a new first housing 106.

The operator then introduces the second blocking device 26 into the second housing 106, in order to block the second sleeve 24 from rotating with respect to the second part 22 about the connection axis X, i.e. in the position chosen from the second plurality of positions.

Advantageously, the operator places the second locking device 30 in the retention groove 136. The second locking device 30 then abuts axially against the abutment surface 122 of the second blocking device 26, preventing the latter from moving out of the second housing 106.

The operator potentially installs the fourth visual sign 108 in the groove 110 of the second sleeve 24, the colour of the fourth visual device being representative of the selected position from the second plurality of positions.

The coding is then complete. On the side of the first connector 12, it is defined by the position of the first sleeve 18, selected from the first plurality of positions, i.e., in the example, by the relative angular positions of the guide rails 64 and the coding recess 50. In the example, there are as many possible codings of the first connector 12 as there are notches in the first plurality of notches 54.

On the side of the second connector 14, the coding is defined by the position of the second sleeve 24 selected from the second plurality of positions, that is, in the example shown, by the relative angular positions of the guide recesses 116 and the coding protrusion 92. In the example, there are therefore as many possible codings of the second connector 14 as there are notches in the second plurality of notches 86.

The possible codings of the first connector 12 and the second connector 14 match each other.

Advantageously, thanks to the third visual sign 78 and the fourth visual sign 108, the operator knows in advance whether s/he can connect the first connector 12 and the second connector 14. Indeed, in principle, if the third visual sign 78 and the fourth visual sign 108 match, this means that the coding of the first connector 12 and the coding of the second connector 14 are compatible with each other.

In this case, the operator can bring the first connector 12 and the second connector 14 closer together along the connection axis X. To do this, the operator brings the first visual sign 70 and the second visual sign 72 into angular correspondence, i.e. aligns them axially. Thus, the guide rails 64 of the first sleeve 24 are aligned with the guide recesses 116 of the second sleeve 24. Interpenetration of the first sleeve 18 and the second sleeve 24 is therefore possible along the connection axis X.

As the coding of the first connector 12 and the second connector 14 are compatible, the coding protrusion 92 of the second part 22 is also axially aligned with the coding recess 50 of the first part 16. In the example, the protrusions 96 are also aligned with the recesses 52.

As a result, the first part 16 and the second part 22 can also interpenetrate axially, allowing the transition from the disconnected to the connected position.

On the contrary, if the codings chosen for the first connector 12 and the second connector 14 were incompatible, the coding protrusion 92 would not be aligned with the coding recess 50, but angularly offset from it about the connection axis X. Interpenetration of the first part 16 and the second part 22 would then not be possible, preventing the transition from the disconnected to the connected position.

Thanks to the features described above, the change of coding is easy to achieve, by unblocking at least one of the sleeves and blocking it in a different position by means of the blocking devices 20, 26. This does not require structural modification of the parts. The most that can be done is to change the visual devices 78, or 108 which are only there as an indication for the operator.

As noted above, many embodiments (not shown) of assembly 10 are possible.

In one embodiment, the second sleeve 24 partially surrounds the first sleeve 18 in the connected position. In this case, the guide rails 64 are no longer on a radially inner surface of the first sleeve 18, but on a radially outer surface.

In other embodiments, the guide rail(s) 64 is/are not defined by the first sleeve 18, but by the second sleeve 24, the guide recesses being defined by the first sleeve.

In another embodiment, the second part 22 partially surrounds the first part 16 around the connection axis X. In this case, the coding protrusion 92 is not defined by a radially outer surface of the second part 22, but by a radially inner surface. Similarly, the coding recess 50 is not defined by a radially inner surface of the first part 16, but by a radially outer surface.

In yet another embodiment, the coding protrusion 92 is not defined by the second part 22, but by the first part 16, and the coding recess 50 is not defined by the first part, but by the second part.

Generally speaking, we have seen that the first sleeve 18 and the second sleeve 24 provide a guiding function when moving from the disconnected position to the connected position, the first part 16 and the second part 22 provide a function of blocking the connection when the codings are incompatible, or allowing the connection when the codings are compatible.

In other embodiments, the guiding function is provided by the first part 16 and the second part 22, while the blocking/unblocking function is provided by the first sleeve 18 and the second sleeve 24.

Even more generally, the guiding and blocking functions may be confused, with the first sleeve 18 and the second sleeve 22 sliding on each other axially only if presented in a certain angular configuration, and the first part 16 and the second part 22 sliding on each other axially only if presented to each other in a certain angular configuration. Thus, when the angular offset between the first sleeve 18 and the first part 16 is equal to the angular offset between the second part 22 and the second sleeve 24, the codings are compatible. Conversely, when these angular offsets are different from each other, the codings are incompatible, because either the first sleeve 16 and the second sleeve 24 abut each other, or the first part 16 and the second part 22 abut each other.

The invention claimed is:

1. An assembly comprising:

a first connector, and a second connector that can be moved in translation relative to the first connector along a connection axis between a disconnected position, in which the second connector is spaced apart from the first connector, and a connected position, in which the first connector and the second connector are connected to each other, a first part attached to the first connector, and a first sleeve surrounding the first part about the connection axis, one of the first sleeve and the first part defining at least one first notch, and the other of the first sleeve and the first part defining a first plurality of notches, the first sleeve being rotatable about the connection axis relative to the first part between a first plurality of positions in which the first notch cooperates with a respective one of the first plurality of notches to form a first housing, the assembly comprising at least a first blocking device suitable for being received in the first housing and for blocking the first sleeve against rotating in one of the first plurality of positions, and a second part attached to the second connector, and a second sleeve surrounding the second part about the connection axis, one of the second sleeve and the second part defining at least a second notch, and the other of the second sleeve and the second part defining a second plurality of notches, the second sleeve being rotatable about the connection axis relative to the second part between a second plurality of positions in which the second notch respectively cooperates with one of the second plurality of notches to form a second housing, the assembly comprising at least one second blocking device suitable for being received in the second housing and to block the second sleeve against rotating in one of the second plurality of positions, the first sleeve and the first part, on the one hand, and the second sleeve and the second part, on the other hand, having shapes suitable for, when the first sleeve is in any one of the first plurality of positions:

allowing the second connector to move from the disconnected position to the connected position when the second sleeve is in a corresponding one of the second plurality of positions, the first sleeve sliding into or over the second sleeve, and the first part sliding into or over the second part during said movement, and blocking said movement if the second sleeve is in any other of the second plurality of positions, the first sleeve abutting the second sleeve, or the first part abutting the second part.

2. The assembly according to claim 1, wherein the first connector and the second connector are both electrical, pneumatic or hydraulic connectors.

3. The assembly according to claim 1, wherein:

one of the first part and the second part defines at least one axially oriented coding recess, and the other of the first part and the second part defines at least one radial coding protrusion suitable for being axially received in the coding recess when the second sleeve is in the said one of the second plurality of positions to allow movement of the second connector from the disconnected position to the connected position and suitable for abutting axially against said one of the first part and the second part when the second sleeve is in any other of the second plurality of positions to block said movement.

4. The assembly according to claim 1, wherein the first blocking device and the second blocking device are pins.

5. The assembly according to claim 1, wherein the first sleeve includes a third visual sign, and the second sleeve includes a fourth visual sign, the third visual sign being indicative of a given position occupied by the first sleeve among the first plurality of positions, and the fourth visual sign being indicative of a given position occupied by the second sleeve among the second plurality of positions.

6. The Assembly according to claim 1, wherein the first sleeve defines at least one axially oriented guide rail, and the second sleeve defines at least one axial guide recess suitable for receiving the guide rail axially and to block the second sleeve from rotating relative to the first sleeve about the connection axis when the second connector moves from the disconnected position to the connected position.

7. The assembly according to claim 6, wherein the first sleeve comprises a first visual sign, and the second sleeve comprises a second visual sign, the first visual sign and the second visual sign being axially aligned when the guide rail is received in the guide recess.

8. The assembly according to claim 1, wherein:

each of the first blocking device and the second blocking device comprises a main portion suitable for being inserted into the first housing and the second housing respectively, and a gripping part intended to be grasped by an operator, and/or the assembly further comprises a first locking device adapted to be secured to the first housing or to the first part and to block the first blocking device in the first housing by abutting axially against an abutment surface defined by the first blocking device, and comprises a second locking device suitable for being fixed to the second sleeve or to the second part and for blocking the second blocking device in the second housing by abutting axially against an abutment surface defined by the second blocking device.

9. The assembly according to claim 8, wherein the first locking device and the second locking device respectively comprise a snap ring, the first sleeve and the second sleeve defining a retention groove suitable for receiving the snap ring, the retention groove extending about the connection axis on a radially inner surface of the first sleeve and the second sleeve respectively.

10. The assembly according to claim 8, wherein the gripping part and the abutment surface of the main part are formed by a shoulder of the first blocking device and the second blocking device respectively.

* * * * *